US006634425B2

(12) United States Patent
King et al.

(10) Patent No.: US 6,634,425 B2
(45) Date of Patent: Oct. 21, 2003

(54) INSTRUMENTED CEMENTING PLUG AND SYSTEM

(75) Inventors: Charles H. King, Houston, TX (US); Mitchell D. Pinckard, Houston, TX (US); Thomas S. Proehl, Houston, TX (US)

(73) Assignee: Noble Engineering & Development, Ltd., Sugar Land, TX (US)

( * ) Notice: Subject to any disclaimer, the term of this patent is extended or adjusted under 35 U.S.C. 154(b) by 0 days.

(21) Appl. No.: 10/177,021

(22) Filed: Jun. 20, 2002

(65) Prior Publication Data

US 2002/0157828 A1 Oct. 31, 2002

Related U.S. Application Data

(63) Continuation of application No. 09/706,072, filed on Nov. 3, 2000, now abandoned.

(51) Int. Cl.[7] ..... E21B 43/00

(52) U.S. Cl. ..... 166/253.1; 166/250.14; 166/153; 166/177.4

(58) Field of Search ..... 166/253.1, 250.04, 166/250.14, 153, 135, 192, 193, 177.4

(56) References Cited

U.S. PATENT DOCUMENTS

| | | | | |
|---|---|---|---|---|
| 4,676,310 A | | 6/1987 | Scherbatskoy et al. | 166/65.1 |
| 4,802,143 A | | 1/1989 | Smith | 367/82 |
| 4,867,237 A | | 9/1989 | Wilson et al. | 166/250 |
| 4,967,853 A | | 11/1990 | Landry | 175/50 |
| 4,971,153 A | | 11/1990 | Rowe et al. | 166/297 |
| 5,323,856 A | | 6/1994 | Davise et al. | 166/253 |
| 5,467,823 A | | 11/1995 | Babour et al. | 166/250.01 |
| 5,666,050 A | * | 9/1997 | Bouldin et al. | 324/207.26 |
| 6,070,662 A | | 6/2000 | Ciglenec et al. | 166/254.1 |
| 6,230,800 B1 | * | 5/2001 | Bryant | 166/250.01 |
| 2002/0020525 A1 | * | 2/2002 | Willauer | 166/187 |

* cited by examiner

*Primary Examiner*—William Neuder
(74) *Attorney, Agent, or Firm*—Pillsbury Winthrop LLP

(57) ABSTRACT

A system for cementing a tubular member in a well bore includes a cementing plug. The cementing plug includes at least one sensor. The system transmits a value measured by the sensor to a surface location. The system may transmit the value measured by the sensor through a cable connected between the plug and the surface location. Alternatively, the system may transmit the value measured by the sensor acoustically to the surface location.

60 Claims, 4 Drawing Sheets

INSTRUMENTED CEMENTING PLUG AND SYSTEM

CROSS-REFERENCE TO RELATED APPLICATION

The present application is a continuation of U.S. application Ser. No. 09/706,072, filed Nov. 3, 2000, titled INSTRUMENTED CEMENTING PLUG AND SYSTEM (abandoned).

FIELD OF THE INVENTION

The present invention relates generally to the field of oil and gas well cementing. More particularly, the present invention relates to an instrumented cementing plug and a system for sending to a surface location data measured by the instrumentation of the cementing plug.

DESCRIPTION OF THE PRIOR ART

During the drilling and at the completion of every oil and gas drilling operation, it is necessary that cementing be done in the borehole. More particularly, the casing or liner must be cemented in the hole in order to support the casing or liner and the hole and to prevent the flow of fluids between formations.

The operations associated with setting and cementing casing and liners in the borehole are generally well known in the art. At the completion of a phase of drilling, the cased and open portions of the well bore are filled with drilling fluid. A casing or liner string is assembled and run into the well bore. Then, a spacer or displacement plug is inserted into the top of the casing or liner above the drilling fluid. The displacement plug serves to separate and prevent mixing of the drilling fluid below the displacement plug and a cement slurry that is pumped into the casing or liner above the displacement plug. After a predetermined quantity of cement slurry has been pumped into the casing or liner, a cementing plug is inserted above the cement slurry. Then, drilling fluid is pumped into the casing above the cementing plug to force the slug of cement slurry down the casing or liner and up the annulus between the casing or liner and the borehole. After cementing, the displacement and cementing plugs, the cementing shoe, and any residual cement in the casing are drilled out.

Good cementing jobs are essential to the successful drilling and completion of oil and gas wells. Currently, operators rely upon proper equipment and skill of personnel in order to achieve a good cementing job. However, occasionally, bad cementing jobs occur. Some of the causes of bad cementing jobs are over-displacement or under-displacement of the cement slurry, which results in the formations not be properly isolated from each other. Another cause of bad cementing jobs channeling within the cement, which results in flow paths within the cement between formations.

Various tests are performed to determine whether or not the cementing job is good. If a cementing job is not good, then remedial operations, such as squeeze jobs, must be undertaken. However, remedial operations, tend to be expensive in terms of equipment and supplies and time.

It is an object of the present invention to provide a system for improving the quality of cementing operations.

SUMMARY OF THE INVENTION

The present invention provides a system for cementing a tubular member, such as a casing or liner string, in a well bore. The system of the present invention includes a cementing plug. The cementing plug includes at least one sensor. The system transmits a value measured by the sensor to a surface location. The system may transmit the value measured by the sensor through a cable connected between the plug and the surface location. Alternatively, the system may transmit the value measured by the sensor in a wireless manner to the surface location. In a cable-connected embodiment, an optical transmitter may be coupled to the sensor and the cable may include an optical fiber. In a wireless embodiment, the signal may be acoustically coupled to the surface. For example, an explosive device for producing an acoustic signal may be coupled to the sensor.

DESCRIPTION OF THE PREFERRED EMBODIMENT

Figure 1:
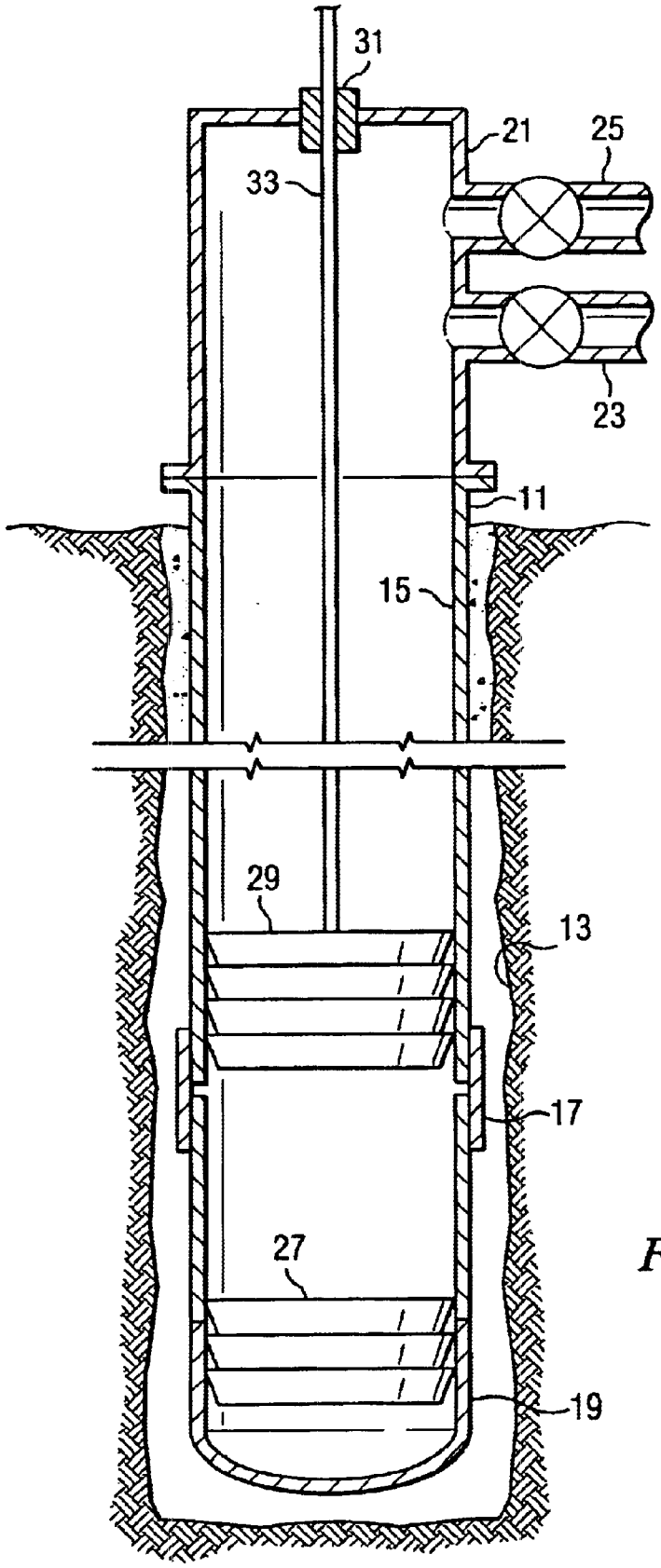
FIG. 1 is a pictorial representation of one embodiment of the system of the present invention.

Referring now to the drawings, and first to FIG. 1, a casing string 11 is shown inserted into a well bore 13. Casing string 11 is of the type generally well known in the art, and it includes a plurality of casing sections 15 connected together by casing collars 17. A cementing shoe 19 is affixed to the bottom end of casing string 11. A plug container 21 is affixed to the upper end of casing string 11. Plug container 21 is of the type generally well known in the art, and it includes a cement inlet 23 and a drilling fluid inlet 25. Plug container 21 is adapted to launch a displacement plug 27 and an instrumented cementing plug 29 into casing string 11.

Cementing plug 29 is generally cylindrical and it includes an upper surface and a lower. The side surfaces of cementing plug 29 are in the form of wipers that engage the inside wall of casing string 11. Cementing plug 29 performs its normal displacement and separation functions. Additionally, as will be explained in detail hereinafter, cementing plug 29 includes various sensor and telemetry instrumentation.

In the embodiment illustrated in FIG. 1, plug container 21 includes a lubricator 31. Lubricator 31 is adapted to sealingly and slidingly engage a cable 33 connected to cementing plug 29. In the preferred embodiment, cable 33 includes an optical fiber. Lubricator 31 allows cable 33 to be run into casing string 11 as cementing plug 29 is pumped downwardly. Cable 33 is preferably releasably connected to cementing plug 29 so that cable 33 may be retrieved through lubricator 31.

Figure 2:
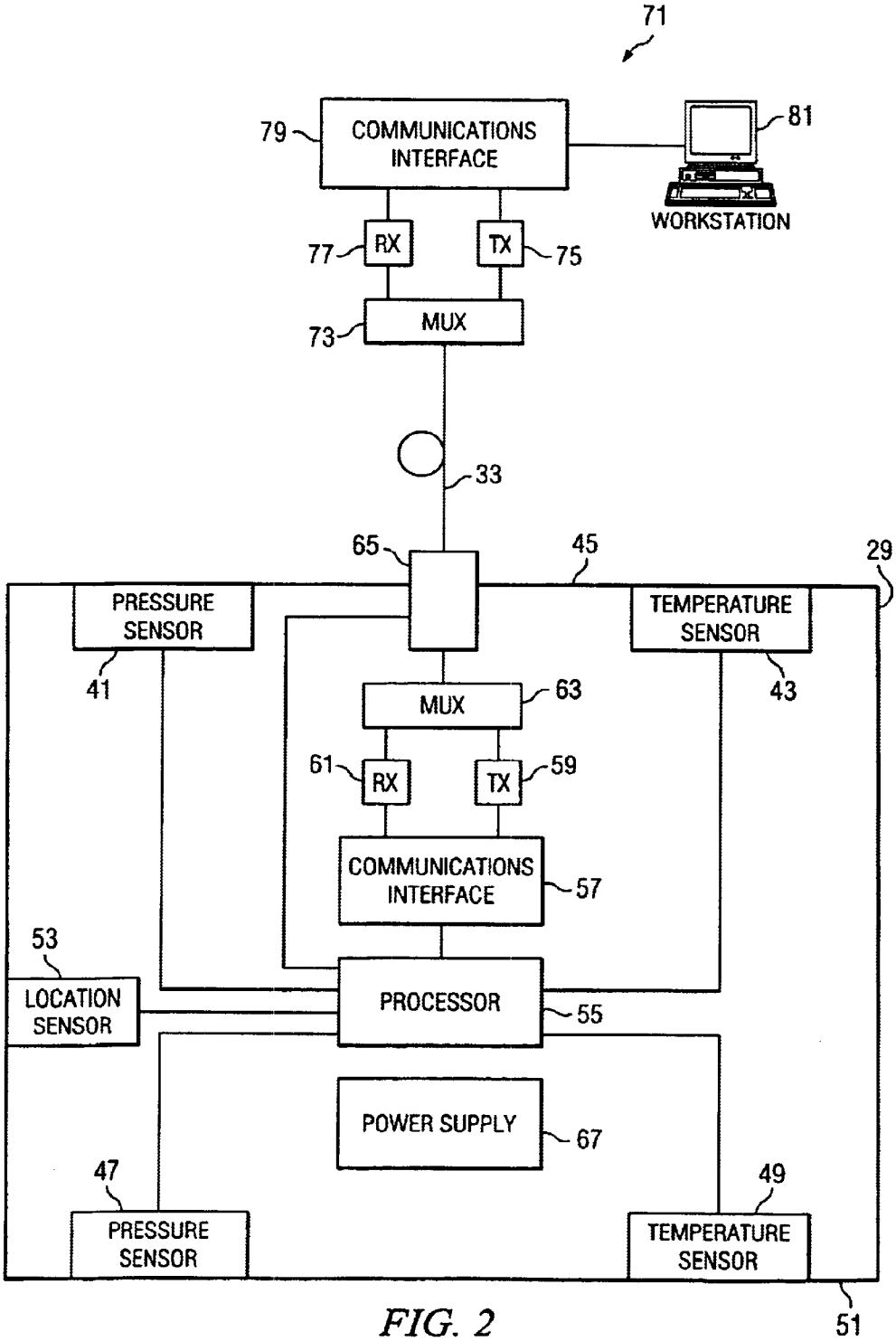
FIG. 2 is a block diagram of the system of FIG. 1.

Referring now to FIG. 2, there is shown a block diagram of a system according to the present invention. In the embodiment shown in FIG. 2, cementing plug 29 includes a plurality of sensors. An upper pressure sensor 41 and an upper temperature sensor 43 are positioned to sense pressure and temperature, respectively, at the upper surface 45 of cementing plug 29. A lower pressure sensor 47 and a lower temperature sensor 49 are positioned to sense pressure and temperature, respectively, at the lower surface 51 of cementing plug 29. The operation and construction of pressure and temperature sensors are generally well known.

Pressure sensors 41 and 47, and temperature sensors 43 and 49, are adapted to output an electrical signal indicative of the pressure or temperature that they sense. The difference in pressure measured by pressure sensors 41 and 47 is useful in determining if there is bypass of displacement fluid around cementing plug 27. Fluid bypass can result in effective over-displacement or under-displacement of the cement slurry or mixing of displacement fluid and the cement slurry, which can cause channeling or an otherwise ineffective cement job.

The setting of cement involves exothermic reactions. Thus, the progress of the setting of the cement can be monitored with reference to the temperature measured by sensors 43 and 49. Those skilled in the art will recognize other information that may be obtained from the pressure and temperature sensors.

Cementing plug 29 also includes a location sensor 53. Location sensor 53 preferably operates magnetically to detect the casing collar. Whenever cementing plug 29 passes a casing collar, location sensor 53 puts out a particular signal. The output of location sensor 53 enables an operator to know the location of cementing plug 29 within casing string 11. Location information is essential to prevent over- or under-displacement of the cement slurry. Location information may also be obtained by measuring the length of cable 33 run into the hole.

The outputs of the sensors are coupled to a processor 55. Processor 55 converts the signals received from pressure sensors 41 and 47 and from temperature sensors 43 and 49 to pressure and temperature values, respectively. Processor 55 counts the signals received from location sensor 53, thereby to determine the location of cementing plug 29 within the casing. Processor 55 also packages the pressure, temperature, and location data according to an appropriate communications protocol for transmission to a surface location. Processor 55 may also perform other processing. For example, processor 55 may compute pressure or temperature differentials between upper surface 45 and lower surface 51 of cementing plug 29.

Cementing plug 29 also includes a communication interface 57 coupled to processor 55. In the embodiment shown in FIG. 2, communications interface 57 is coupled to an optical transmitter 59 and to an optical receiver 61. Optical transmitters and receivers are generally well known in the art. The output of optical transmitter 59 and the input of optical receiver 61 are coupled to a multiplexer 63. Multiplexer 63 is coupled to a releasable optical coupler 65, which in turn is coupled to optical cable 33. In the embodiment shown in FIG. 2, coupler 65 is operated to release cable 33 by a signal from processor 55. A power supply indicated generally by the numeral 67 supplies power to the components of cementing plug 29.

Cementing plug 29 is expendable in that it is not intended to be retrieved at the completion of use. Also, the instrumentation components of cementing plug 29 that are left downhole after optical cable 33 has been retrieved are drillable so that they may be drilled out. While the sensors and processors have been illustrated as discrete components, the sensing and processing functions may be integrated into a smart sensor built on a single semiconductor chip.

The system illustrated in FIG. 2 includes surface equipment, indicated generally by the numeral 71. Surface equipment 71 includes a multiplexer 73 coupled to optical cable 33. Multiplexer 73 is coupled to an optical transmitter 75 and an optical receiver 77. The output of optical receiver 77 and the input of optical transmitter 75 are coupled to a communications interface 79, which in turn is coupled to a workstation or personal computer 81. Workstation 81 is adopted to run an operating system, such as Windows 98 (tm) or Windows NT (tm), and various application programs according to the present invention. The application programs provide a user interface that displays data and enables an operator to interact with the system. The application programs also process data received from cementing plug 29, to calculate and display location, pressure, and temperature information. As is apparent, the system of FIG. 2 enables bi-directional communication between surface location 71 and cementing plug 29. The bi-directional communication enables, among other things, an operator at surface to cause the actuation of coupler 65 to release cable 33. Preferably, coupler 65 includes an explosive element adapted to release cable 33.

Figure 3:
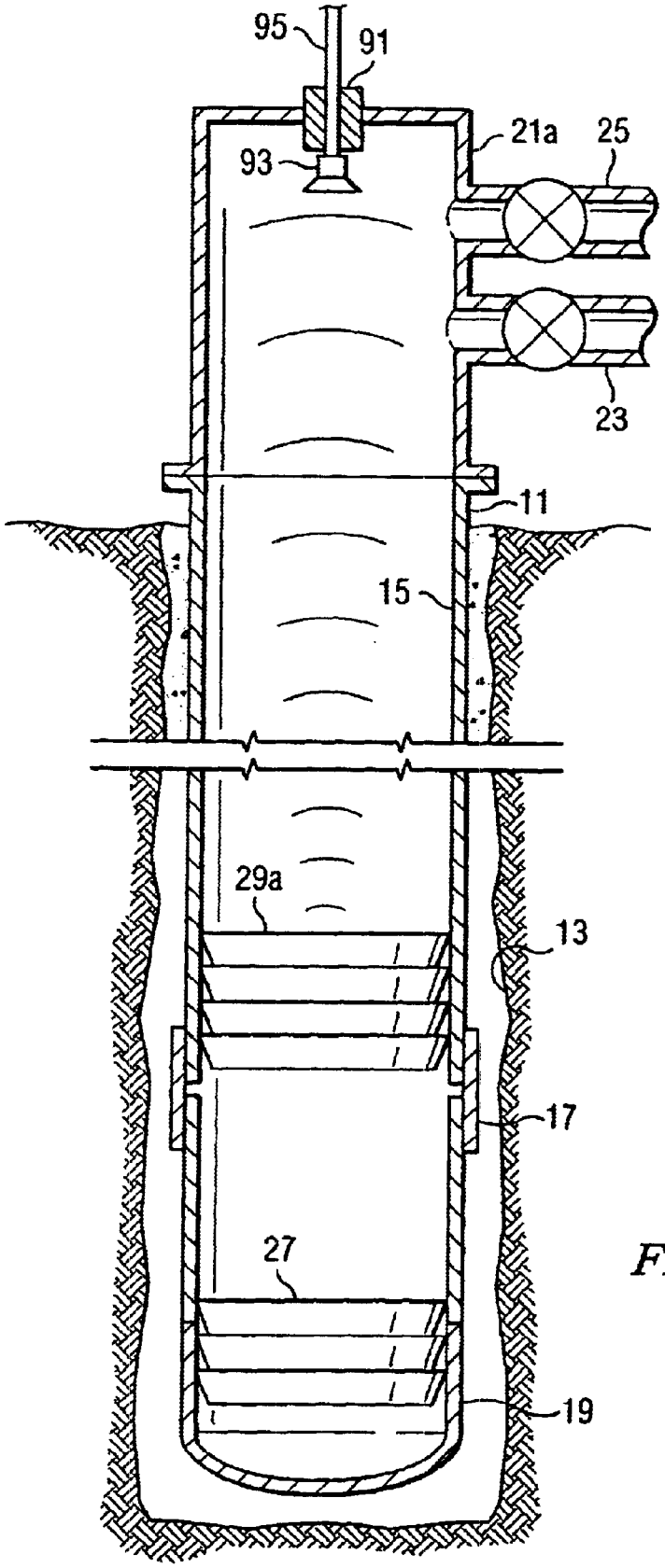
FIG. 3 is a pictorial representation of an alternative embodiment of the system of the present invention.

Referring now to FIG. 3, there is illustrated an alternative embodiment of the present invention. The embodiment of FIG. 3 is similar to the embodiment of FIG. 1, except that information from cementing plug 29*a* is coupled to surface equipment acoustically, rather than optically. Thus, plug container 21*a* includes a transducer 93 that is coupled to surface equipment by a cable 95 that passes through a stuffing box 91.

Figure 4:
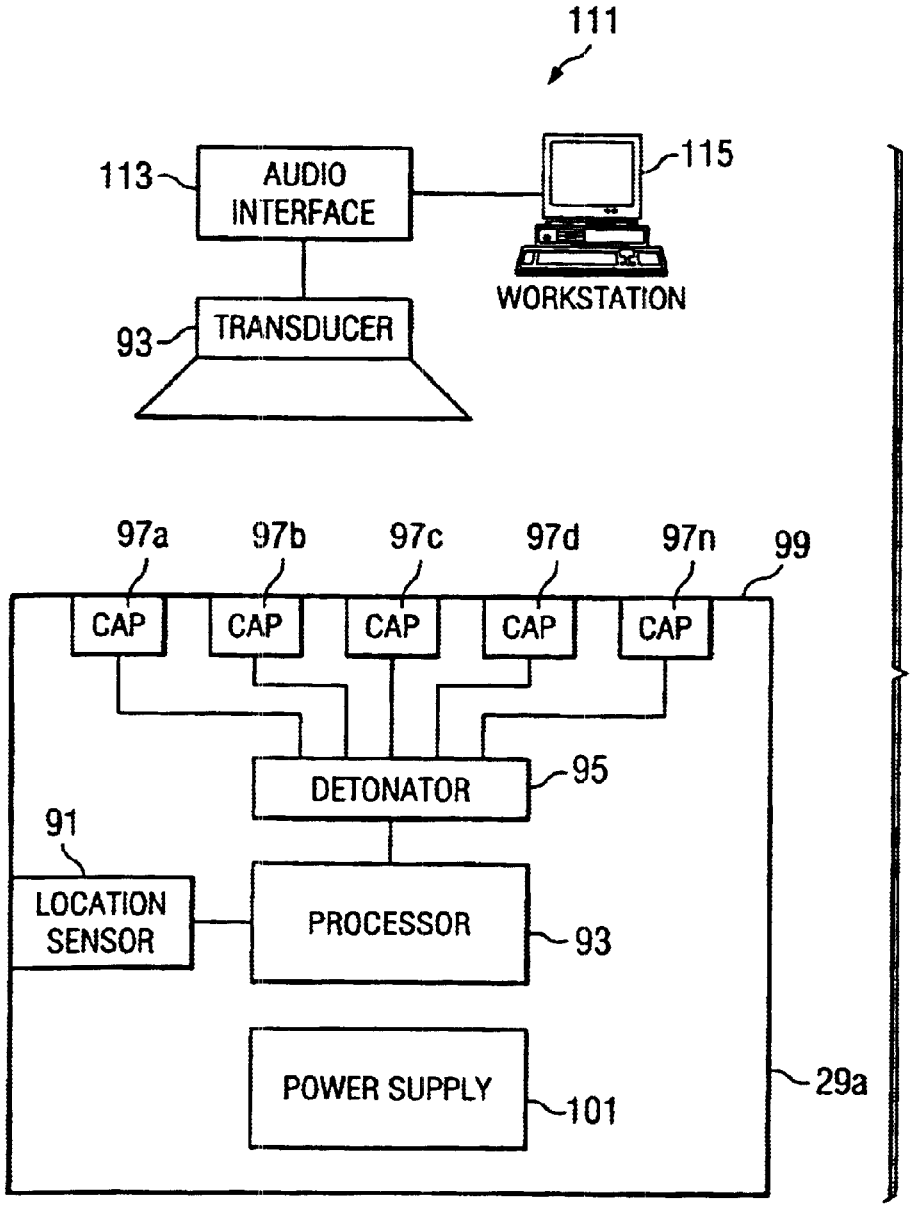
FIG. 4 is a block diagram of the system of FIG. 3.

Referring now to FIG. 4, there is shown a block diagram of the system of FIG. 3. Cementing plug 29*a* includes a location sensor 91 that operates substantially in the same way as the location sensor of the system of FIG. 2. The output of location sensor 91 is coupled to a processor 93. Processor 93 is coupled to a detonator 95, which is adapted to selectively detonate explosive caps 97. Explosive caps 97 are disposed in an array adjacent the upper surface 99 of cementing plug 29A. In the preferred embodiment, each cap 97 has a distinctive acoustic signature that enables the signal of a particular cap 97 to be distinguished from that of another. Thus, the detonation of caps 97 may be coded with information obtained from location sensor 91.

Generally, the acoustic coupling of the system of FIG. 4 provides lower bandwidth than the optical coupling of the system of FIG. 2. Thus, in FIG. 4, only the location sensor 91 is shown. However, by increasing the size of the array of caps 97 additional information may be transmitted and the number and types of sensors may be increased. A power supply 101 supplies power to the components of cementing plug 29*a*.

The system of FIG. 4 includes surface equipment, designated generally by the numeral 111. Surface equipment 111 includes transducer 93, which is coupled to an audio interface 113. Audio interface 113 is coupled to a workstation or processor 115. Surface equipment 111 receives and processes acoustic signals from cementing plug 29*a*. In the system illustrated with respect to FIG. 4, an operator is provided with location information. Those skilled in the art will recognize other wireless downhole telemetry systems, such as mud pulse and electromagnetic systems.

From the foregoing, it will be apparent that the present invention provides an improved cementing system. The system of the present invention provides real-time measurements of downhole conditions and plug locations, thereby enabling an operator to take corrective actions before the cement has set. The system of the present invention thus reduces or eliminates the need for costly post-cementing remedial actions.

The system of the present invention has been illustrated and described with respect to presently preferred embodiments. Those skilled in the art will recognize, given the benefit of the foregoing disclosure, alternative embodiments. Accordingly, the foregoing disclosure is intended for purposes of illustration rather than limitation.

What is claimed is:

1. A system for cementing a tubular member in a well bore, which comprises:

a cementing plug, said cementing plug being generally cylindrical and having an upper surface, a lower surface, and at least one tubular member wall contacting surface, said cementing plug including at least one sensor; and, means for transmitting a value measured by said at least one sensor to a surface location.

2. The system as claimed in claim 1, wherein said means for transmitting said value includes a cable connected between said cementing plug and said surface location.

3. The system as claimed in claim 2, wherein said cable includes an optical fiber.

4. The system as claimed in claim 2, wherein said cable is releasably connected to said cementing plug.

5. The system as claimed in claim 1, wherein said means for transmitting said value includes:

a processor positioned in said cementing plug and coupled to said at least one sensor; and, a communications interface positioned in said cementing plug and coupled to said processor.

6. The system as claimed in claim 5, wherein said means for transmitting said value further includes:

an optical transmitter positioned in said cementing plug and coupled to said communications interface.

7. The system as claimed in claim 6, wherein said means for transmitting said value further includes:

an optical fiber coupled between said optical transmitter and said surface location.

8. The system as claimed in claim 5, wherein said means for transmitting said value further includes:

a communications cable coupled between said communications interface and said surface location.

9. The system as claimed in claim 1, wherein said means for transmitting said value includes:

an acoustic transmitter coupled to said sensor.

10. The system as claimed in claim 9, wherein said acoustic transmitter includes:

an explosive device positioned in said cementing plug.

11. The system as claimed in claim 10, wherein said explosive device has an acoustic signature indicative of said value.

12. The system as claimed in claim 11, wherein said means for transmitting said value includes:

a transducer; and, a processor located at said surface location and coupled to said transducer to interpret said acoustic signature.

13. The system as claimed in claim 9, wherein said means for transmitting said value includes:

a transducer; and, a processor positioned at said surface location and coupled to said transducer.

14. The system as claimed in claim 1, wherein said at least one sensor includes a pressure sensor positioned to sense pressure at one of said upper or lower surfaces of said cementing plug.

15. The system as claimed in claim 1, wherein said at least one sensor includes a temperature sensor positioned to sense temperature at one of said upper or lower surfaces of said cementing plug.

16. The system as claimed in claim 1, wherein said at least one sensor includes a location sensor.

17. A system for cementing a tubular member in a well bore, which comprises:

a cementing plug, said cementing plug being generally cylindrical and having an upper surface, a lower surface, and at least one tubular member wall contacting surface, said cementing plug including at least one sensor and a first communications interface coupled to said at least one sensor;

a second communications interface coupled to said first communications interface; and, a processor coupled to said second communications interface.

18. The system as claimed in claim 17, wherein said first and second communications interfaces are coupled by a cable.

19. The system as claimed in claim 18, wherein said cable includes an optical fiber.

20. The system as claimed in claim 18, wherein said cable is releasably connected to said cementing plug.

21. The system as claimed in claim 19, including:

an optical transmitter positioned in said cementing plug and coupled to said communications interface.

22. The system as claimed in claim 17, wherein said first communications interface is acoustically coupled to said second communications interface.

23. The system as claimed in claim 22, wherein said cementing plug includes:

an acoustic transmitter coupled to said sensor.

24. The system as claimed in claim 23, wherein said acoustic transmitter includes:

an explosive device positioned in said cementing plug.

25. The system as claimed in claim 24, wherein said explosive device has an acoustic signature indicative of said value.

26. The system as claimed in claim 22, wherein said second communications interface includes a transducer.

27. The system as claimed in claim 17, wherein said at least one sensor includes a pressure sensor positioned to sense pressure at one of said upper or lower surfaces of said cementing plug.

28. The system as claimed in claim 17, wherein said at least one sensor includes a temperature sensor positioned to sense temperature at one of said upper or lower surfaces of said cementing plug.

29. The system as claimed in claim 17, wherein said at least one sensor includes a location sensor.

30. The system as claimed in claim 17, wherein said cementing plug includes a plurality of sensors coupled to said first communications interface.

31. The system as claimed in claim 30, wherein said sensors include an upper pressure sensor positioned to sense pressure at said upper surface of said cementing plug and a lower pressure sensor positioned to sense pressure at said lower surface of said cementing plug.

32. The system as claimed in claim 30, wherein said sensors include an upper temperature sensor positioned to sense pressure at said upper surface of said cementing plug and a lower temperature sensor positioned to sense temperature at said lower surface of said cementing plug.

33. A cementing plug, which comprises:

a plug body, said plug body being generally cylindrical and having an upper surface, a lower surface, and at least one tubular member wall contacting surface;

at least one sensor mounted in said plug body; and, a communications interface coupled to said at least one sensor.

34. The cementing plug as claimed in claim 33, including means for coupling a communications cable to said communications interface.

35. The cementing plug as claimed in claim 34, wherein said communications cable is releasably connected to said cementing plug.

36. The cementing plug as claimed in claim 33, wherein said communications interface includes an acoustic transmitter.

37. The cementing plug as claimed in claim 36, wherein said acoustic transmitter includes:

an explosive device positioned in said cementing plug.

38. The cementing plug as claimed in claim 37, wherein said explosive device has an acoustic signature indicative of a value sensed by said at least one sensor.

39. The cementing plug as claimed in claim 33, wherein said at least one sensor includes a pressure sensor positioned to sense pressure at one of said upper or lower surfaces.

40. The cementing plug as claimed in claim 33, wherein said at least one sensor includes a temperature sensor positioned to sense temperature at one of said upper or lower surfaces.

41. The cementing plug as claimed in claim 33, wherein said at least one sensor includes a location sensor.

42. The cementing plug as claimed in claim 33, wherein said cementing plug includes a plurality of sensors coupled to said communications interface.

43. The cementing plug as claimed in claim 42, wherein said sensors include an upper pressure sensor positioned to sense pressure at said upper surface and a lower pressure sensor positioned to sense pressure at said lower surface.

44. The cementing plug as claimed in claim 43, wherein said sensors include an upper temperature sensor positioned to sense temperature at said upper surface and a lower temperature sensor positioned to sense pressure at said lower surface.

45. A cementing plug, which comprises:

a plug body, said plug body being generally cylindrical and having an upper surface, a lower surface, and at least one tubular member wall contacting surface; and, at least one sensor positioned in said plug body.

46. The cementing plug as claimed in claim 45, including:

a processor positioned in said plug body and coupled to said at least one sensor.

47. The cementing plug as claimed in claim 46, including a communications device coupled to said processor.

48. The cementing plug as claimed in claim 47, wherein said communications device includes an optical transmitter.

49. The cementing plug as claimed in claim 47, wherein said communications device includes:

a detonator positioned in said plug body and coupled to said processor; and, at least one explosive device positioned in said plug body and coupled to said detonator.

50. The cementing plug as claimed in claim 47, wherein said communications device includes:

a detonator positioned in said plug body and coupled to said processor; and, an array of explosive devices positioned in said plug body and coupled to said detonator.

51. The cementing plug as claimed in claim 50, wherein said each explosive device of said array is individually detonatable by said detonator.

52. A cementing system, which comprises:

a cementing plug body, said cementing plug body having an upper surface, a lower surface, and at least one wall contacting surface defined by at least one wiper member; and, at least one sensor positioned in said cementing plug body.

53. The cementing system as claimed in claim 52, including:

a processor positioned in said cementing plug body and coupled to said at least one sensor.

54. The cementing system as claimed in claim 53, including a communications device coupled to said processor.

55. The cementing system as claimed in claim 54, wherein said communications device includes an optical transmitter.

56. The cementing system as claimed in claim 54, wherein said communications device includes:

a detonator positioned in said cementing plug body and coupled to said processor; and, at least one explosive device positioned in said cementing plug body and coupled to said detonator.

57. The cementing system as claimed in claim 54, wherein said communications device includes:

a detonator positioned in said cementing plug body and coupled to said processor; and, an array of explosive devices positioned in said cementing plug body and coupled to said detonator.

58. The cementing system as claimed in claim 57, wherein said each explosive device of said array is individually detonatable by said detonator.

59. The cementing system as claimed in claim 52, including a communications device coupled to said at least one sensor.

60. The cementing system as claimed in claim 59, including a receiver positioned at a location remote from said cementing plug body and coupled to said communication device.

* * * * *